United States Patent [19]

Levenston

[11] Patent Number: 4,645,198

[45] Date of Patent: Feb. 24, 1987

[54] NECK EXERCISING DEVICE

[76] Inventor: Frederick M. Levenston, 105 East Tamarack, Inglewood, Calif. 90301

[21] Appl. No.: 762,372

[22] Filed: Aug. 5, 1985

[51] Int. Cl.[4] ..... A61H 3/00

[52] U.S. Cl. ..... 272/70.3; 128/75; 128/76 R; 128/84 C; 272/119

[58] Field of Search ..... 128/25 R, 68–75, 128/76 R, 84 C; 272/70, 70.3, 119

[56] References Cited

U.S. PATENT DOCUMENTS

| | | | |
|---|---|---|---|
| 198,871 | 1/1878 | Case | 128/75 |
| 2,625,202 | 1/1953 | Richardson | 272/70.3 |
| 2,855,202 | 10/1958 | Kinne | 128/76 R |
| 3,156,239 | 11/1964 | Uribe | 128/75 |
| 3,336,922 | 8/1967 | Taylor | 128/75 |
| 3,957,040 | 5/1976 | Calabrese | 128/75 |
| 4,188,966 | 2/1980 | Palmer | 272/70.3 |
| 4,352,352 | 10/1982 | Janovsky | 128/76 R |

FOREIGN PATENT DOCUMENTS

| | | | |
|---|---|---|---|
| 2269977 | 12/1975 | France | 128/76 R |
| 1048148 | 11/1966 | United Kingdom | 272/70.3 |
| 564863 | 8/1977 | U.S.S.R. | 272/70 |

OTHER PUBLICATIONS

Strength and Health Magazine, Jan. 1973, p. 17.

*Primary Examiner*—Clyde I. Coughenour
*Attorney, Agent, or Firm*—Ben E. Lofstedt

[57] ABSTRACT

A neck exercising device including an upright frame means capable of surrounding the upright torso of a human being, including a pair of handle means for manually gripping the frame means, a plurality of weighted objects, a plurality of flexible ropes one end of each of the ropes being securable to one of the weighted objects, guide means secured to the frame means for guiding each of the plurality of ropes, means for securing the ropes to the weighted objects, and means for securing the unattached ends of the ropes to the head of the person using the neck exerciser.

7 Claims, 9 Drawing Figures

NECK EXERCISING DEVICE

BACKGROUND OF THE INVENTION

1. Field of the Invention

The present invention relates to neck exercising devices and, more particularly, to neck exercising devices having a stand-up frame with a plurality of weighted objects suitable for exercising the human neck while standing in an upright position.

2. Description of the Prior Art

The prior art is noticeably lacking in devices useful in specifically exercising the human neck.

One of the known devices utilized in the prior art for exercising the human neck, involves the use of a series of straps of cloth material which is sewn or otherwise secured together to form a hat-like pocket for cradling the head of the person whose neck is to be exercised. Portions of the straps are arranged to depend from the hat portion of this prior art device so as to extend substantially below the neck and shoulders of the person performing the neck exercise routine but not, typically, below the waist of such user, the ends of such straps terminating in loops for anchoring suitable weighted objects thereto.

Use of this prior art neck exercising device is accomplished by placing the hat portion over the head of the person whose neck is to be exercised, affixing one or more weighted objects to the looped portions of the depending straps and thereafterwards moving the neck up and down and side to side. With the weighted objects providing a constant pull or "force" which is transmitted to the user's neck via the depending straps and the hat structure formed by the sewn straps, the neck is exercised along with the muscles of the human body which are associated with the movement of the human neck.

Another means utilized in the prior art involved no device, but simply the use of the hands of the person. By placing the palm of the hand against the head and pushing and resisting the neck movements, the neck was exercised along with the muscles associated therewith.

A yet still further prior art neck exercising method involved the use of the head and neck muscles to lift a portion of the weight of the human body up from the floor or a wall. This is accomplished by placing the neck in intimate abuttment with the floor or a vertical wall and allowing the body to be moved by forcing the neck muscles to "lift" a portion of the body away from and towards the wall or floor in a back and forth fashion. Of course, such a neck exercising routine or regime did not involve the use of a device.

All of the prior art methods discussed above, which are the only ones known to the applicant herein, are deficient in a number of aspects. First, with respect to the hat and weighted objects apparatus, the user cannot comfortably stand up and exercise his neck because the weighted objects contact his body which is in some cases intolerable and in other cases, simply a nuisance and a source of irritation. To eliminate this body contact with the weighted objected, the user had to sit down and position his neck forward of his body and above the opening between his legs, and the weighted objects dangling from the hat/strap combination were targeted for positioning between the spread-apart legs.

Second, with respect to the manual methods of exercising the neck, there is no provision for consistently and uniformly repeating the same degree of resistance or force as applied to the neck and its muscles. Additionally, the degree of movement of the neck and its muscles are severely restricted and fail to provide the necessary and desired freedom of motion necessary to fully exercise the neck and its associated muscles.

For these important and significant reasons, and others as hereinafterwards further discussed and enumerated, the present neck exercising device was created.

SUMMARY OF THE INVENTION AND OBJECTS

With respect to the present invention disclosed more fully hereinafterwards, such may be fundamentally described as a neck exercising apparatus which is directed to be used primarily for freely exercising the human neck while the person is standing in an upright position. Basically, it is a neck exercising device including an upright frame means capable of surrounding the upright torso of a human being, including a pair of handle means for manually gripping the frame means, a plurality of flexible ropes one end of each of the ropes being securable to one of the weighted objects, guide means secured to the frame means for guiding each of the plurality of ropes, means for securing the ropes to the weighted objects, and means for securing the unattached ends of the ropes to the head of the person using the neck exerciser.

It is one object of the instant invention to provide a means for exercising the neck while standing in an upright position.

Another object of the instant invention is to provide a portable means for exercising the neck so that it can be easily transported from one location to another.

A yet still further and primary object of the invention is to provide a neck exercising device which is suitable for therapeutic recovery from injuries to the neck and its associated muscles.

One object of the invention is to provide a neck exercising apparatus which is economical and convenient to manufacture.

A yet another object of the invention disclosed herein is to provide a neck exerciser which can provide for precise adjustment of the degree or magnitude of the forces applied to the neck during the exercise regime.

Another important and significant object of the invention is to provide a neck exerciser for increasing the strength of the neck and its muscles.

It is one object of the invention to provide a neck exerciser which will also support the person engaging in the neck exercising routine to prevent the person from possibly falling during the routine.

Another significant object of the instant invention is to provide a neck exerciser which is capable of being easily and quickly dismantled for storage during periods of non-use.

Another object of the invention is to provide a neck exerciser with a full range of distributive neck motion so that all degrees of neck rotation can be quickly and easily accommodated.

Other objects and features of the invention will become readily apparent as the disclosure and description of the invention continues herein, and by reference to the numerous illustrations and drawings which illustrate one preferred embodiment of the invention and the use thereof.

DETAILED DESCRIPTION OF THE PREFERRED EMBODIMENT OF THE INVENTION

Figure 7:
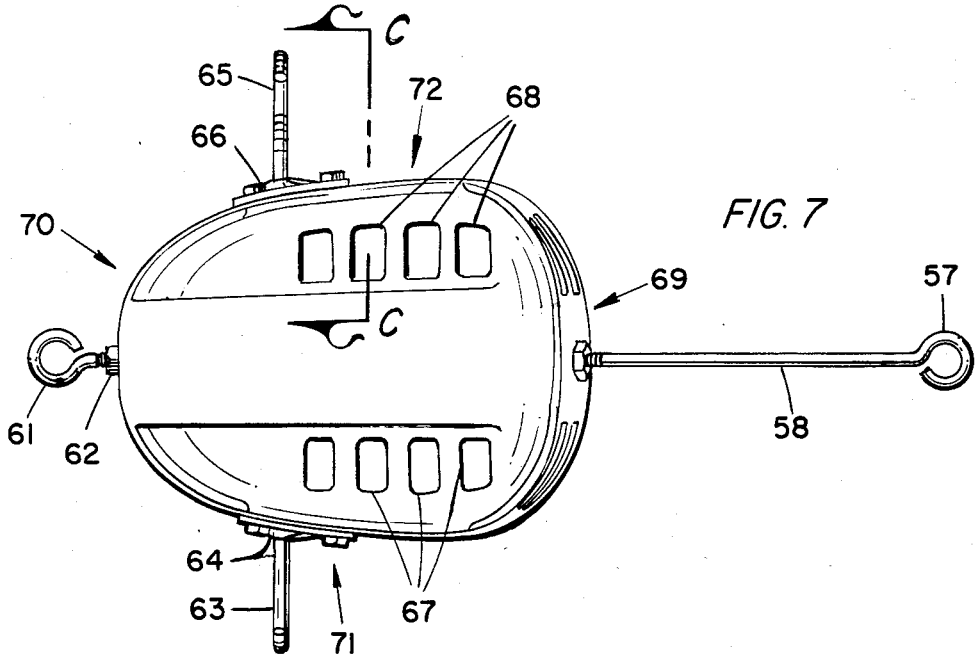
FIG. 7 is a top plan view of the helmet portion of the invention.
Figure 8:
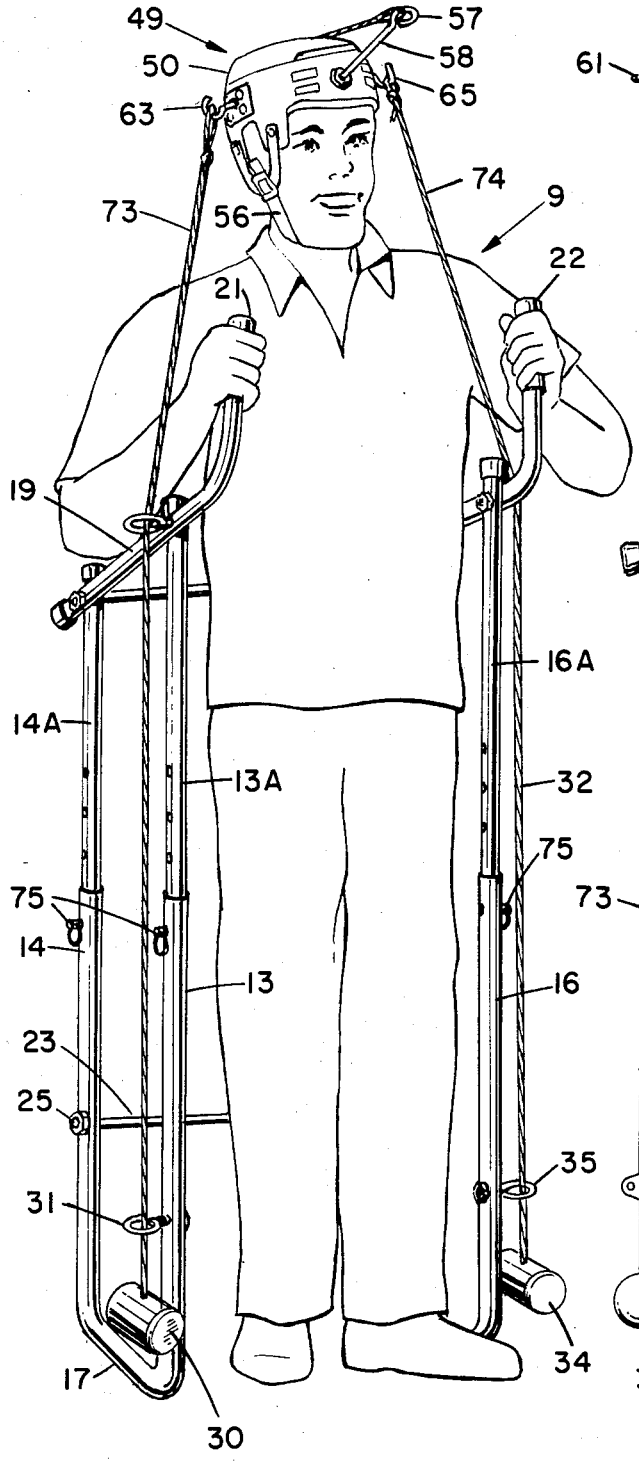
FIG. 8 is a perspective view of the invention shown with a person using same.
Figure 9:
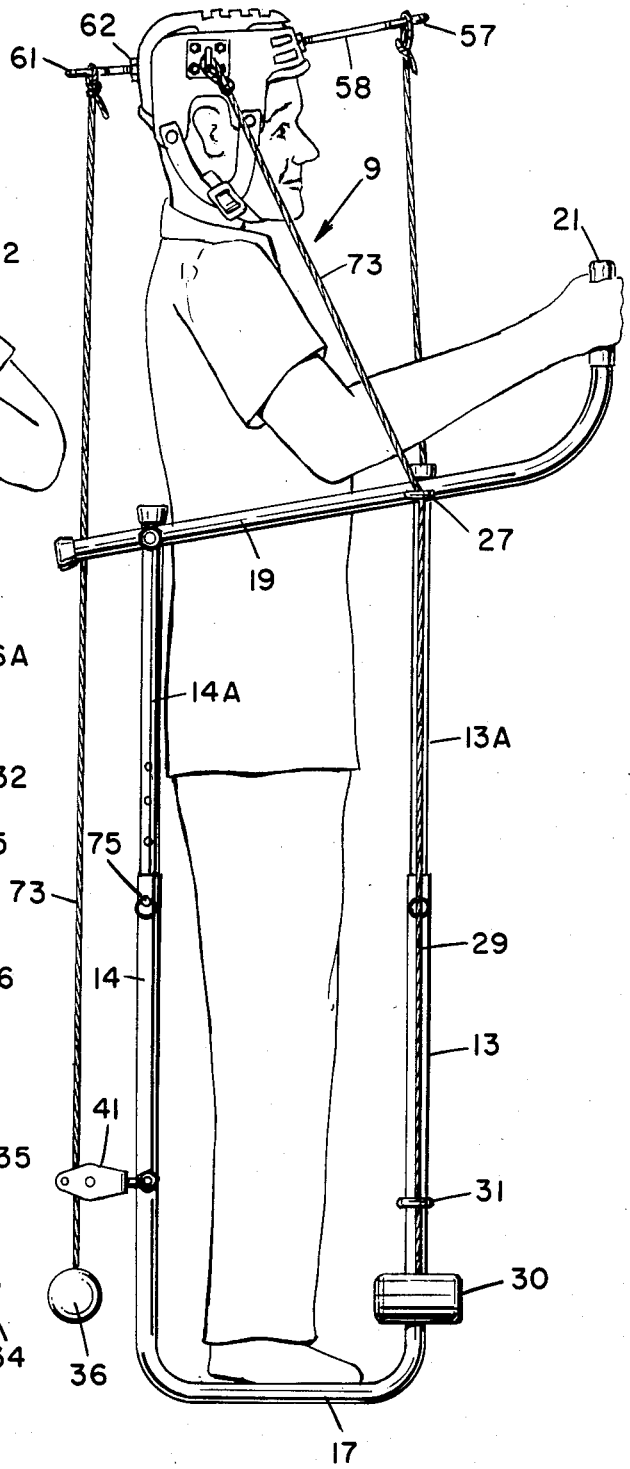
FIG. 9 is a side vertical elevational view of both the neck exercising frame and the helmet portion of the present invention shown in use.

With continuing reference to all of the drawings herein, and, more specifically now to FIGS. 1, 4, 7–9, inclusive, there is shown the present invention, a neck exerciser, generally indicated at 9 in FIGS. 8 and 9, which includes, generally, a free-standing exercise frame 10, a helmet 70 with a plurality of anchoring hooks 57, 61, 63, and 65 thereon, a plurality of weights 30, 34, and 36, a plurality of cables 37, 38, 39, one end of each of the cables 37, 38, 39 is operably connected to one of the anchoring hooks 57, 61, 63 and 65 on the helmet 70 and the other end of which is operably coupled to one of the weights 30, 34, and 36, and cable guiding eyelets 27, 28, 31, and a cable guiding pulley 40 anchorably secured to the frame 10.

Figure 1:
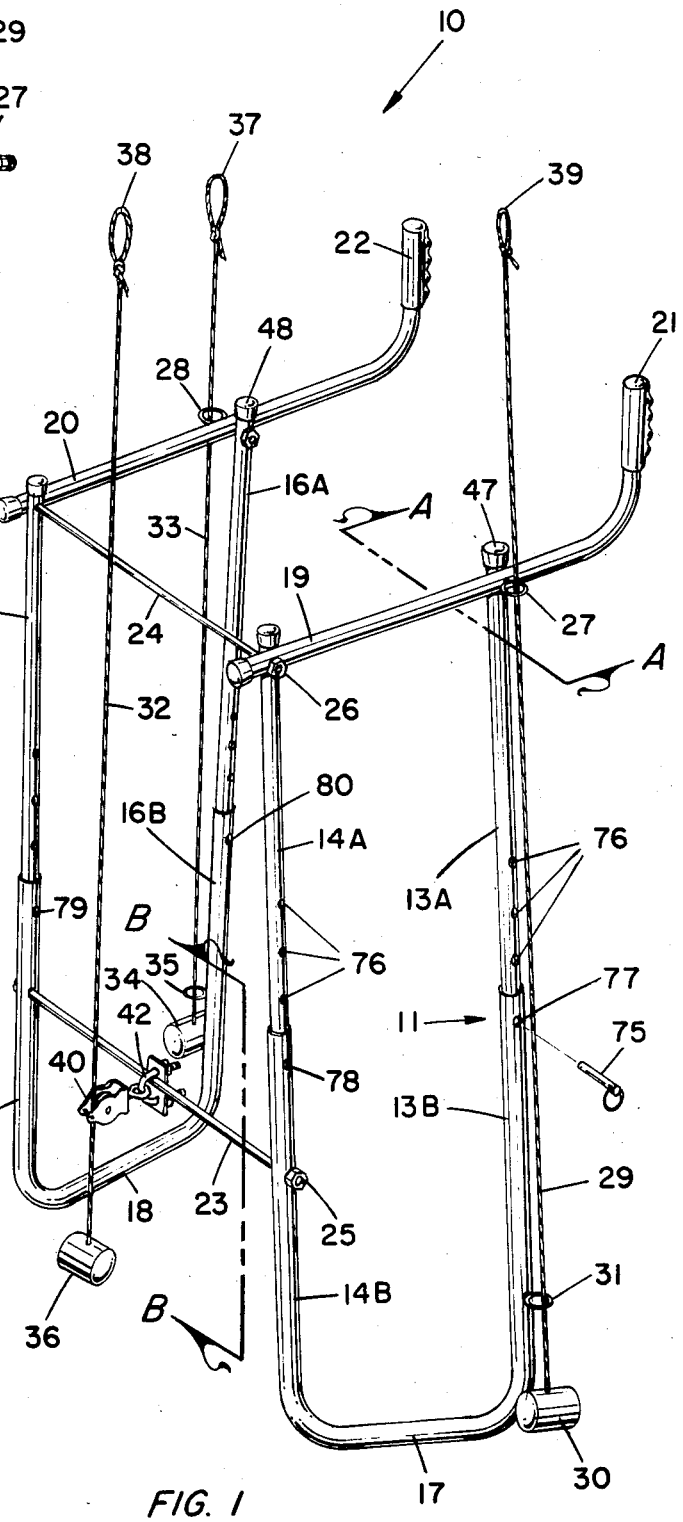
FIG. 1 is a perspective view of the new improved neck exercising machine disclosed herein.

The frame 10, as clearly shown in FIG. 1, includes a pair of vertically-disposed, U-shaped members, generally indicated at 11 and 12. Each of said U-shaped members 11 and 12 consists of three tubular metal elements. The U-shaped frame member 11 includes a U-shaped element having a bottom portion 17 which is designed to rest firmly on the floor, and a pair of substantially parallel sleeves 13B, 14B, with at least a pair of apertures 77, 78, respectively, in the uppermost ends thereof. The sleeves 13B, 14B are slightly larger in inside diameter so as to freely receive a pair of extension arms 13A, 14A, with a plurality of apertures 76 arranged in spaced-apart vertical relationship. The purpose and function of such apertures 76 will become increasingly clear as the description and operation of the present invention proceeds further hereinafterwards.

A pair of horizontally-arranged crossbars 23, 24 are secured through appropriately aligned apertures in the sleeves 14B, 15B and the extension arms 14A and 15A, respectively, and the undercut, threaded ends thereof terminated and secured in position by a pair of nuts, of which nuts 25 and 26 are typical. The purpose and function of this pair of crossbars 23, 24 are to assist in the formation of a free-standing frame 10 by maintaining the U-shaped members 11 and 12 in a spaced-apart relationship at least the width of the standing body of the person using this neck exerciser 9.

The vertical height of the U-shaped members 11 and 12 can be adjusted by raising or lowering the extension arms 13A, 14A, 15A, 16A, and aligning the various apertures respectively contained therein with the corresponding apertures 77, 78, 79, 80 contained in the sleeves 13B, 14B, 15B, 16B and passing a pull-locking pin, such as indicated at 75, thereinthrough.

A pair of tubular metal crossmembers 19, 20 are secured to the uppermost portions of the extension arms 13A, 14A, 15A, 16A by aligning the apertures contained therein with the apertures in the pair of tubular crossmembers 19, 20 and passing the threaded crossbar 24 therethrough on the outermost ends thereof and nutting them, and a pair of eyelets 27, 28 with threaded extensions thereon which are passed through the aligned apertures in the crossmembers 19, 20 and the uppermost portions of the extension arms 13A, 14A, 15A, 16A.

Figure 2:
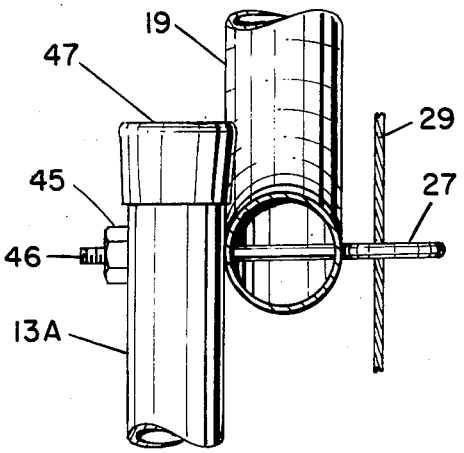
FIG. 2 is an enlarged view of a portion of the invention shown partially in section taken along Plane A—A of FIG. 1.

With special emphasis now on FIG. 2, there is shown in enlarged detailed form a section taken along Plane A—A of FIG. 1, the precise method whereby the crossmember 19 is secured by means of an eyelet 27 having a threaded stem portion 46 associated therewith which is passed through a plurality of aligned apertures in the crossmember 19 and the extension arm 13A and nutted using nut 45. A plastic cap 47 is stretched over the open end of the tube forming the extension arm 13A to prevent debris from entering thereinto. Such a cap is typical to place over the tubing ends for this purpose. As can be readily seen from the Figure, the cable 29 is arranged to be guided by eyelet 27. The purpose of joining these various members together is to form a strong, yet lightweight and rigid frame member 10. The forwardmost extremities of the crossmembers 19, 20 are curved upwardly to form a pair of handles 21, 22 which are used by the person exercising his or her neck to manually grip same with his or her hands to steady themselves during the neck exercise routine. Such use is clearly shown and described in FIGS. 8 and 9 of the drawings herein.

Three cables 37, 38, 39 with loops in the uppermost ends thereof are passed through guides, such as the eyelets 27, 28 and the pulley 40, to weights 30, 34, 36 at the opposite ends of the cables 37, 38, 39. Additional eyelet cable guides 31, 35 are utilized in conjunction with eyelet cable guides 27, 28, respectively.

Cable 38 is, alternatively, guided by a pulley 40.

Figure 3:
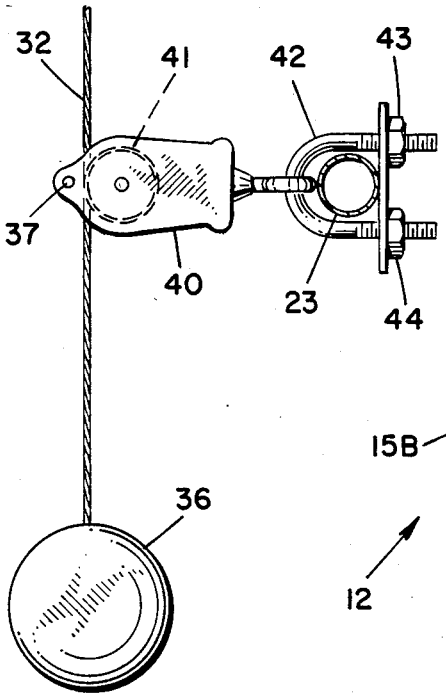
FIG. 3 is an enlarged view of a portion of the invention shown partially in section taken along Plane B—B of FIG. 1.

Turning now to FIG. 3, there is shown in enlarged fashion, a view of a portion of the present invention taken along Plane B—B of FIG. 1. As seen herein, there is shown the pulley to which is secured via an eyelet swivel to a U-bolt and backing plate 42 which is secured about the crossbar 23 and removably locked thereabout by the nuts 43, 44 engaged with the threaded portions of the U-bolt and backing plate 42. A pulley wheel 41 is provided to guide the cable 32 which supports a weight 36. A pin 37 is provided to ensure that the cable 36 does not disengage from the pulley 40.

Figure 4:
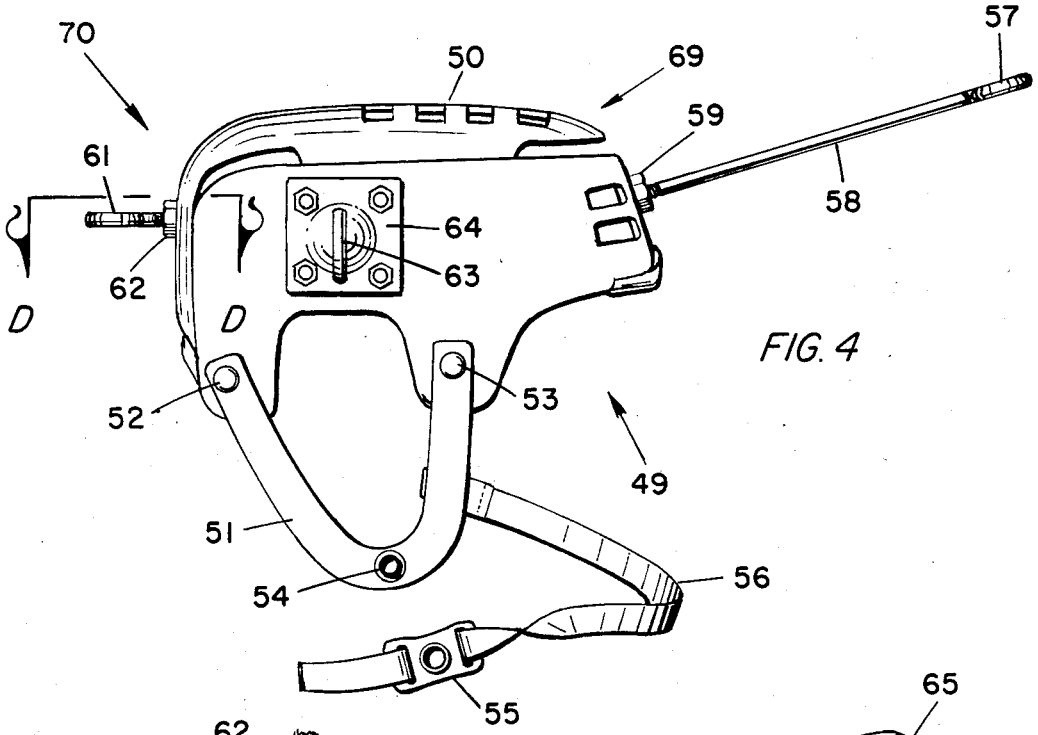
FIG. 4 is a side elevational view of the headgear of the invention to be used in conjunction with the inventive apparatus of FIG. 1 of the Drawings.
Figure 5:
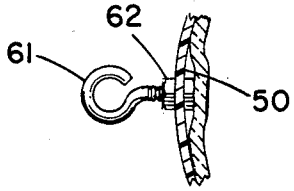
FIG. 5 is an enlarged view of a portion of the invention shown partially insection taken along Plane D—D of FIG. 4.
Figure 6:
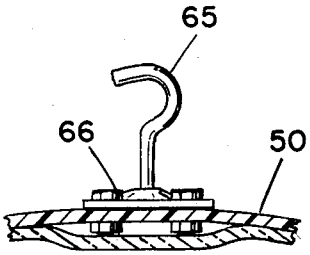
FIG. 6 is an enlarged view, shown partially in section, taken along Plane C—C of FIG. 7.

With special emphasis now on FIG. 4, there is shown a helmet, generally indicated at 50, which includes a crown portion, a forwardmost portion, generally indicated at 69, a rearwardmost portion, generally indicated at 70, and side portions, which are generally indicated, respectively, at 71, 72, a plurality of eyelets 57, 61, 63, 65 with threaded arms and plates 64, 66, and helmet anchoring interfaces 59, 62. A chin strap 51, 56 is adapted for snapping into place at 54 and is anchored to the helmet 70 at 52, 53. FIG. 5, which is a view taken along Plane D—D of FIG. 4 illustrates, in detail, the method for anchoring the eyelet 61 to the hard plastic outer casing of the helmet 70. FIG. 6 is a view taken along Plane C—C of FIG. 7 illustrating the method of attaching eyelet 65 and its associated base plate 66 to the hard outer casing of the helmet 50. Vent holes 67, 68 are provided to ensure the comfort of the neck exerciser user.

USE OF THE PRESENT INVENTION

With special reference now to FIGS. 8, 9, there is shown a person actually in a standing, ready-to-use position with the invention 9. As shown, the person places himself within the frame 10 standing in an upright position. The vertical height of the frame 10 is adjusted by pulling the locking pins 75 out of their engagement with the sleeves 13, 14, 15 and 16 and the extension arms 13A, 14A, 15A, and 16A, respectively, and the apertures in the extension arms 13A, 14A, 15A, and 16A arranged to be aligned with the apertures in the sleeves 13, 14, 15 and 16 as desired and then re-inserted so that the extension arms 13A, 14A, 15A, and 16A can be locked at the desired height.

Following this, the cables having the weights 30, 34 and 36 attached to the lowermost ends thereof, are passed through the eyelets 31, 35 and pulley 41, and other eyelets as needed and the uppermost ends, which are terminated in small loops, are attached to the eyelets 57, 61 and hooks 63, 65 which are affixed to the helmet 50.

While standing in this upright position, and manually gripping the two handles 21, 22, the person moves his head from side-to-side and front-to-back in order to exercise his neck. In so doing the weighted cables are kept in alignment and the person is able to precisely exercise his neck, a feat which, heretofore, was not practicable. The weights can be increased or decreased as desired for the most beneficial effect on the user.

While there has been described in detail herein a particular embodiment of the present invention, such is not by any means intended to be limited to the particular embodiment given as a illustration of the principles of the instant invention, but such is intended only to be limited by the spirit and scope of the claims appended hereto.

What is claimed is:

1. A neck exerciser, comprising:

(a) a free-standing frame wherein a person may stand in an upright position therebetween;

(b) a pair of handles projecting forwardly from the uppermost forward portion of the frame, said handles providing for manually gripping thereof to steady and support the person using the neck exerciser;

(c) a helmet adapted to fit over the head of the user of the neck exerciser, said helmet having a plurality of hooks projecting from the front, rear and the two sides of said helmet;

(d) a plurality of cables the uppermost portions of which are operably secured to the plurality of hooks secured to the helmet;

(e) cable guiding means secured to the frame for guiding said cables; and (f) weight means operably secured to the lowermost portions of said plurality of cables.

2. The neck exerciser of claim 1, wherein said frame is formed of metal tubing.

3. The neck exerciser of claim 1, wherein said pair of handles are formed as an extension of said frame.

4. The neck exerciser of claim 1, wherein said cable guiding means are eyelets having threaded stems depending therefrom for threadably securing same to the frame.

5. The neck exerciser of claim 1, wherein said helmet has a hard plastic case.

6. The neck exerciser of claim 1, wherein said weight means are adjustable as desired.

7. The neck exerciser of claim 1 wherein said frame includes:

(a) a pair of U-shaped tubular members, the bottom of said U being adapted to rest on top of the floor and further having at least one aperture in each of the uppermost ends of said vertical arms of said U-shaped members;

(b) a double pair of extension arms adapted to freely slide into the vertical arms of said U-shaped tubular members, said arms having a plurality of apertures therein, said apertures being operably alignable with the pair of apertures in said vertical arms of the U-shaped tubular members; and (c) means for adjustably locking said vertical arms with said each of said extension arms through said alignable apertures therein to lock said extension arms with said vertical arms so that the frame can be adjusted in vertical height to accomodate persons of different heights.

* * * * *